US006383253B1

(12) United States Patent
Evertz et al.

(10) Patent No.: US 6,383,253 B1
(45) Date of Patent: May 7, 2002

(54) METHOD FOR ALLOYING STEELS AND DEVICE FOR CARRYING OUT THE METHOD

(75) Inventors: Ralf Evertz, Leichlingen; Stefan Evertz, Solingen, both of (DE)

(73) Assignee: Egon Evertz KG (GmbH & CO), Solingen (DE)

( * ) Notice: Subject to any disclaimer, the term of this patent is extended or adjusted under 35 U.S.C. 154(b) by 0 days.

(21) Appl. No.: 09/601,553

(22) PCT Filed: Mar. 27, 1999

(86) PCT No.: PCT/DE99/00932

§ 371 Date: Jul. 31, 2000

§ 102(e) Date: Jul. 31, 2000

(87) PCT Pub. No.: WO99/51785

PCT Pub. Date: Oct. 14, 1999

(30) Foreign Application Priority Data

Apr. 2, 1998 (DE) ..... 198 14 748

(51) Int. Cl.[7] ..... C21C 7/072

(52) U.S. Cl. ..... 75/531; 266/83; 266/216; 266/270

(58) Field of Search ..... 75/531; 266/216, 266/83, 270

(56) References Cited

U.S. PATENT DOCUMENTS 2,577,764 A 12/1951 Hulme et al.
3,011,829 A 12/1961 Wiseman et al.
4,652,306 A * 3/1987 Nakashima et al. ..... 75/10.17

FOREIGN PATENT DOCUMENTS

| | | | | |
|---|---|---|---|---|
| DE | 2 326 603 | | 12/1973 | |
| DE | 34 18 455 | A1 | 1/1985 | |
| DE | 227 452 | A1 | 9/1985 | |
| DE | 42 37 177 | A1 | 1/1994 | |
| DE | 44 00 029 | A1 | 7/1995 | |
| EP | 0 579 591 | A1 | 1/1994 | |
| GB | 2 013 851 | A | 8/1979 | |
| JP | 62192520 | A * | 8/1987 | ..... 75/538 |

OTHER PUBLICATIONS

"Einblasen Von Feststoffen . . . " by J. Wendorff, published in Technische Mitteilungen Year 70, vol. 2, Feb. 1977.

"Einblasverfahren Zur Roheisen– Und Stahlbehanlung . . . ", by H.P. Haastert et al., published in Stahl und Eisen 105 (1985) No. 11, No month.

"Verfahrenb Von Pulverinjecktion in Stahlschmelzen", by S. Krauss published in Neue Hütte, Year 24, vol. 6, Jun. 1979.

* cited by examiner

*Primary Examiner*—Roy King
*Assistant Examiner*—Tima McGuthry Banks
(74) *Attorney, Agent, or Firm*—Herbert Dubno

(57) ABSTRACT

Alloying and/or reducing powder is pumped directly into the steel melt at a pressure of at least 20 bar, preferably at least 40 bar, with at most 20% of a fluidizing agent and the powder is discharged from the delivery line by a plunger extending across the cross section thereof.

19 Claims, 2 Drawing Sheets

METHOD FOR ALLOYING STEELS AND DEVICE FOR CARRYING OUT THE METHOD

CROSS REFERENCE TO RELATED APPLICATIONS

This is a national stage of PCT/DE99/00932 filed Mar. 27, 1999 and is based upon the German national application 198 14 748.1 filed Apr. 2, 1998 under the International Convention.

FIELD OF THE INVENTION

The invention relates to a method for alloying steel by introducing metallic additives and/or reducing agents in powder form into a fluid metallic melt. The invention relates further to a device for implementing the method.

BACKGROUND OF THE INVENTION

The present invention pertains to the field of secondary metallurgy, i.e. the further processing of, for instance, a steel produced by means of a refining process in a converter or in an electric-arc oven. A particular part of this further processing is establishing the composition of the steel alloys, during which the desired metallic additives are introduced. Optionally in this phase also an additional deoxidation, decarburization or desulfurization of trace elements can be performed.

From DE 42 37 177 A1 a mechanically adjustable dosage and delivery device for goods in powder form is known, which introduces one or more kinds of various powders in metered amounts into a pig iron melt, through a delivery device ending in an immersion lance. This dosage and delivery device is used for blowing and particularly for co-injection of calcium carbide and magnesium powders into pig iron melts.

The DE 44 00 029 A1 attempts in a similar fashion to achieve an adjustably metered introduction of additives into electric-arc furnaces, crucibles or pouring ladles. In all these cases the respective solid material in powder form is introduced by means of a carrier gas which according to the state of the art amounts to approximately 80% and more of the total gas-solids mixture. However, a difference in flow rates or flow velocity of the used carrier gases and the solid materials makes impossible a precise dosage or adjustment of the alloying elements to be introduced, or of the alloying elements in relation to the deoxidation elements, which negatively influences the production of the alloyed steel.

For this reason in establishing the composition of the steel alloy, one works with hollow wire in whose inner space the metals and/or deoxidizing agents are arranged in compressed powder form. This wire is unwound by means of a spooler directly into the bath, where the wire melts and releases the alloying elements. For instance wires with a diameter of up to 23 mm and a wall thickness of 0.5 mm are used and the filling material is disposed therein. The production of such wires filled with alloying elements in powder form is expensive. Furthermore the wire spooling method has the disadvantage that the melting wire end does not always lie in the desired location under the bath surface, so that different concentrations of alloying elements arise in the melt.

The more cost-efficient and technically simpler technology, which allows the alloy powders to trickle from above onto the bath surface has again the disadvantage that, because of the existing bath movements, which are directed radially outward on the surface of the metal bath, the alloying agents are pushed against the ladle or converter walls, where they adhere to the slag deposits or to the inner surface of the melt container. Since this happens in an uncontrollable manner depending on different bath movements, this method also can lead to undesirable alloy compositions, which do not correspond with the metal alloying requirements.

OBJECT OF THE INVENTION

It is therefore the object of the present invention to so improve the method described at the outset that alloying additives alone or alloying additives in connection with reducing agents can be introduced in a precise dosage into the melt, with better dosage accuracy.

SUMMARY OF THE INVENTION

This object is achieved, according to the invention, in that the alloying additives and/or the alloying additives and reducing agents are introduced in the melt as powders (dry) from a supply container via a conveying device directly to one or more lances and/or below-bath nozzles into the melt, or are introduced into the melt in a mixture with a fluidizing agent, whose proportion in the injected amount is $\leqq 20\%$, whereby the pressure used for the powder conveyance is at least 20 bar, preferably 40 bar, or whereby the powders in the delivery line are discharged by means of a plunger covering the cross section of the delivery line.

The injection technology of solids via lances or below-bath nozzles is used in a modified manner, in that the respective additives are injected into the melt dry (i.e. without gas or other fluidizing agent) at a conveying pressure of 40 bar and more or that the amount of the fluidizing agent is limited to a maximum of ⅕ in the gas-solid powder mixture and the mixture is injected at a pressure of more than 20 bar. The conveying pressure decreases correspondingly to the friction losses towards the lance or below-bath nozzle, whereby the pressure at which the powders are discharged decreases to values which are only slightly above the ferrostatic pressure. Surprisingly it has been found that an optimal dosage can be achieved, in spite of the considerable friction losses, which exist and which according to earlier assumptions were considered to endanger a uniform introduction of additives. It is also surprising that, when one is working with a lower proportion of fluidizing agents or without fluidizing agents, pressures between 20 bar and 40 bar are sufficient in order to overcome the frictional resistance.

As an alternative it is possible to push out the powder in the delivery line and/or the lance by means of a plunger covering the entire cross section of the delivery line. This method limits the amount of powder which can be introduced by means of the plunger, as well as the cross section of the delivery line through which the plunger is moved. The delivery line or lance segment has to be filled again after each powder discharge. Suitably the powder exit point at the lance is closed by a cover during refilling, which melts away when the lance is introduced into the melt.

As already mentioned, fluidizing agents can also be used, such as small amounts of inert gas, particularly argon or nitrogen, or of liquid hydrocarbons, such as heating or diesel oil, heavy oil, waste oil, rape seed oil or paraffin. The use of liquid hydrocarbons, such as waste oil, which burns in the melt, create disposal possibilities, which make it possible to avoid the treatment of waste oil as a special disposal waste.

So for instance preferably powders with a maximum grain size of 1 mm, preferably of maximum 0.1 mm, are used, particularly in the "dry" injection without gas or liquids.

A fluidization of the powders can also be performed so that compressed alloying additives form a core surrounded by a shell containing lubricants, e.g. paraffin, wax, oil or the like. The respective particles consisting of core and shell can be used without the addition of further fluidizing agents, or with a further small proportion of gaseous or liquid fluidizing agents.

According to a further embodiment of the invention, the alloying additives are injected in powder form through a swingable lance.

By this one has to understand such oscillating motions which make possible to move the lance exit opening out of the bath, as well as such oscillating motions which allow the setting of different positions of the lance exit opening below the bath surface.

Advantageously the lance is designed as a ring nozzle, and in a further embodiment as a double-wall ring nozzle, whereby through one of the exit openings defined by the double wall inert gases can be injected into the melt, by means of which the lance can be cooled and/or a stirring motion can be produced in the melt. An optimization of this stirring motion can be achieved when the lance exit opening is designed so that the inert gases are delivered tangentially. Through the second exit opening, the dry or fluidized powder, consisting of additives, is then pressed in. In this way it is possible to generate different bath motions with the pure inert gas injected through the lance, depending on the dosage of the additives, which are supposed to be the more intensive the greater the amount of metal or deoxidizing agents introduced per unit time. Different from the methods known to the state of the art, it is possible to adjust independently the dosage amount per time unit and the bath motion.

According to a further development of the invention, a pressure between 50 bar and 100 bar is used for the compression of the additives in powder form.

The aforedescribed process of the invention, which can be applied in steel plants as well as in foundries, offers several possibilities for introducing alloy components, such as aluminum, silicon, magnesia, calcium, and various carbides into the melt. In addition to the volumetric dry transport over a dosage and compression transport, there is the volumetric conveyance of the gas-powder mixture or of the gas-liquid mixture, whereby the proportion of gas or liquid amounts to a maximum of 20% of the mixture. The fourth possibility consists in the aforedescribed volumetric transport of the mixture with a "dry core" of the additives to be introduced and a wet shell or a pasteous powder mix, consisting preferably of hydrocarbons, which have lubricant capability.

Thereby the following advantages result:

The proportion of fluidizing agent (inert gas, liquid) is reduced to a minimum. The dosage takes place via a volume measurement, which is more accurate than the conventional gravimetrical method, or of a throughflow measurement. The conveying pressure can be varied depending on the flowability of the powdery solid materials. Finally it is possible to establish the composition of the alloys according to specification during treatment. The dosages can be performed dust-free and with reduced emissions. Since there are no large amounts of transport gas (as is normally the case according to the state of the art), or only a small fluidization in the supplied product, the additives, the residence time of the additives in the reaction zone of the lance opening in the melt also increases.

For implementing the aforedescribed method a device is used wherein, a delivery line having a high-pressure pump leads directly from a supply container to a lance or a below-bath nozzle. These measures reduce considerably the energy consumption with respect to the conventional techniques. Also reduced are the service and maintenance.

According to a further development of the invention, the delivery line has an air or liquid inlet, preferably with an dosage adjusting device depending on the amounts supplied from the supply container, by means of which the desired mixing ratio powder: (fluidizing agents, respectively lubricants) can be set.

The lance has a double shell with two discharge openings, through one of which flows the metal in powder form or the reducing agent, optionally fluidized, and through the other flows the inert gas. In the ideal case, the discharge opening, respectively openings of the lance are arranged so that they abut tangentially. The lance itself is preferably swingable. The bath (the melt) can be arranged in a converter, a ladle or a torpedo carriage.

BRIEF DESCRIPTION OF THE DRAWING

Embodiments of the invention are represented in the drawing. In the drawing.

SPECIFIC DESCRIPTION

Figure 1:
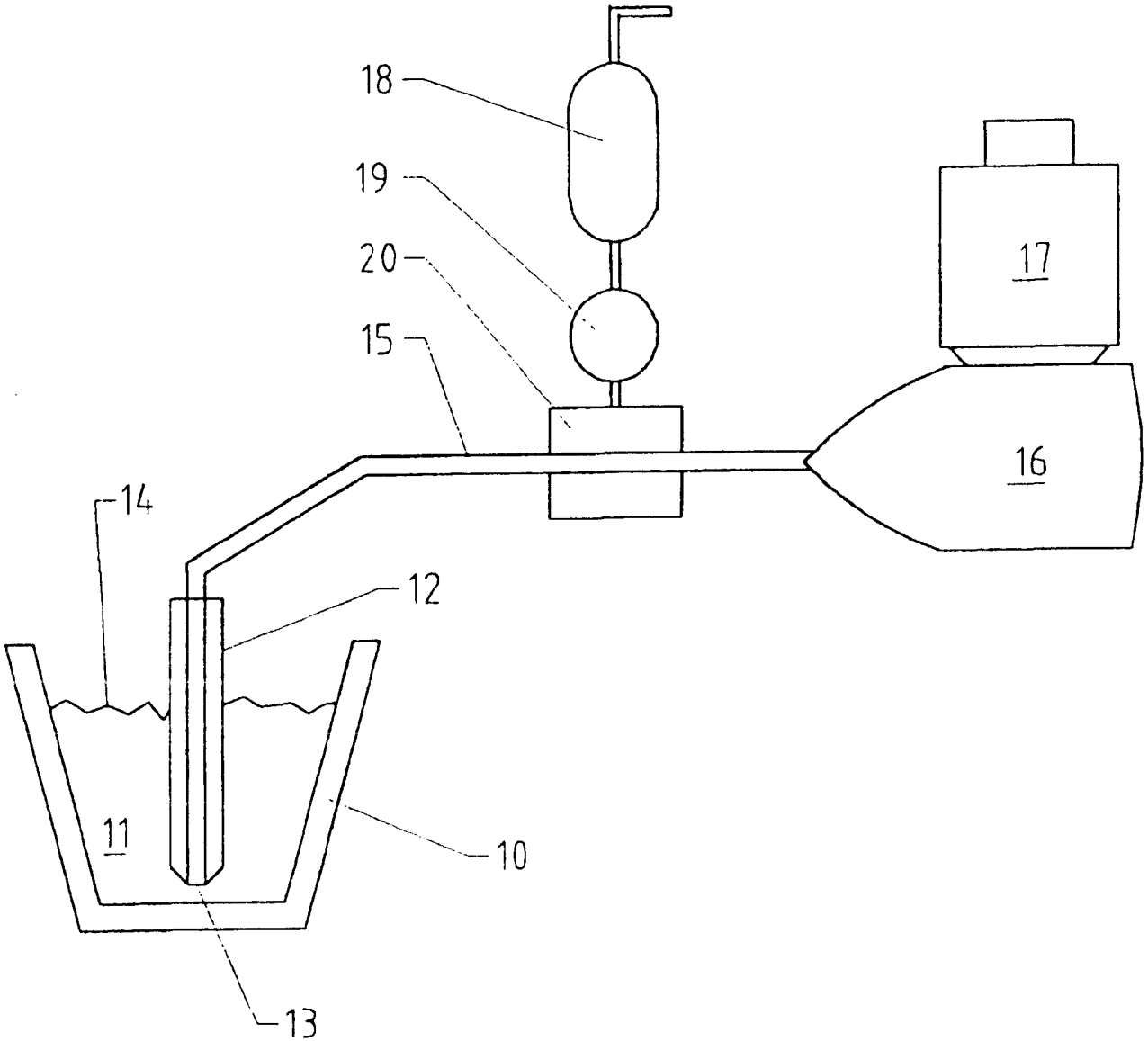
FIG. 1 is a schematic view of a device according to the invention.

The device shown in FIG. 1 basically consists of a metallurgic vessel 10 with a melt bath 11 in which a lance 12 is immersed. The lance outlet 13 is below the bath surface 14. This lance, which has an annular shape, is connected with a delivery line 15 from a pump 16. The metal or metal mixture in powder form with an optionally added reducing agent, coming from a supply container 17, is delivered by the pump 16. Optionally several dosage devices are provided, which can optimally set the desired mix proportions.

If a gas is to be admixed to the powder conveyed under a pressure of at least 20 bar, this is done by means of a supply from a gas container 18, from which the gas is introduced into an inlet 20 in the line 15 by applying pressure by means of a pump. Measuring devices known to the state of the art which are connected to respective dosage adjustment devices are not illustrated.

Figure 2:
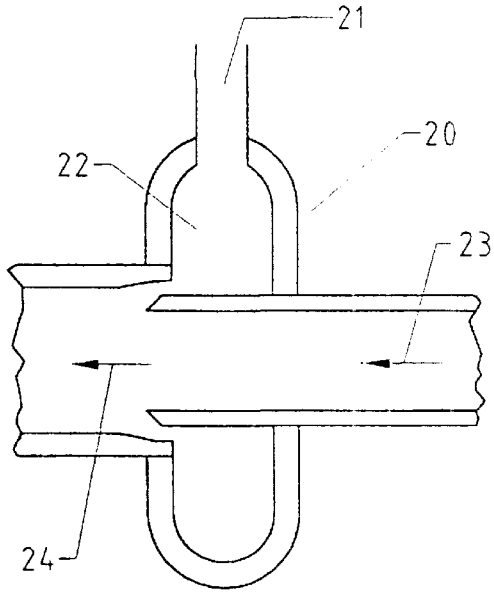
FIG. 2 is a schematically enlarged representation of an inlet point in the delivery line for the fluid admixture.
Figure 4:
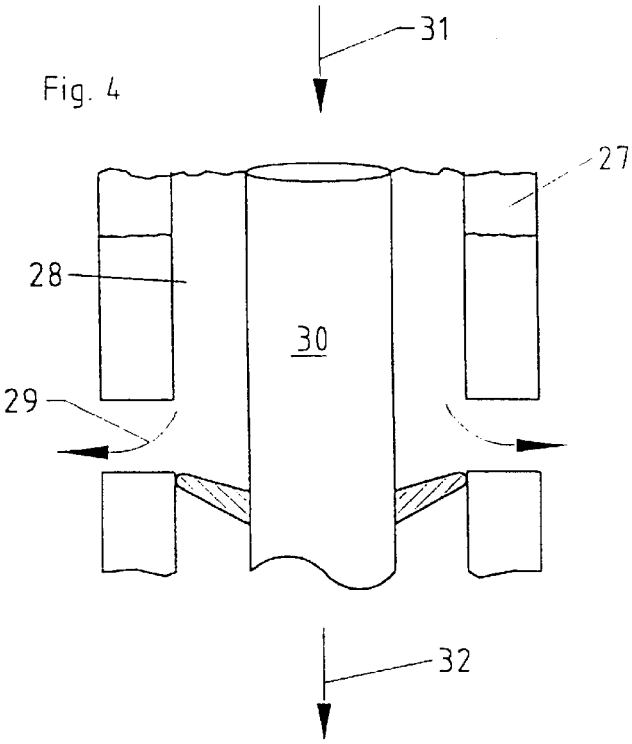
FIG. 4 is a longitudinal section of a lance with two outlet channels.
Figure 3:
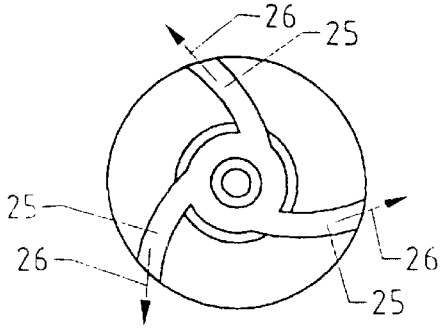
FIG. 3 is a cross-sectional view of a lance with tangential outlet openings.

FIG. 2 shows also in a schematic view an inlet point for inert gases or liquids, which are fed in the direction of arrow 21 via an annular duct 22. The fluid means supplied in this way mixes with the powder stream, which is conveyed under a pressure of for instance 40 to 50 bar in the direction of arrow 23, whereby a solid/gas or solid/liquid mixture is formed, which is guided in the direction of arrow 24 towards the lance 12. Below the bath surface, the lance has outlet openings 25 (FIG. 3), which open almost tangentially, or in the ideal case tangentially, causing a whirling motion of the exiting powder or powder mixture in the direction of arrow 26 (see FIG. 3). A longitudinal view of a double-walled lance is shown in FIG. 4. This lance, as is known in the art, is surrounded by a fireclay lining 27, has an annular channel 28. The metallic additions in powder form , with or without a fluidizing agent, are discharged through this channel in the direction of arrow 29. In addition, via the inner pipe 30 an inert gas can be passed in the direction of arrow 31, respectively 32, whose throughput or velocity can be adjusted independently from the flow of the additions (alloying agents, reducing agents).

Pumps and dosage device of the used kind are basically known to the state of the art, for instance from the cement industry, where ready-mixed cement mash is conveyed under high pressure.

The metallurgic vessel 10 can be a ladle, a torpedo carriage or a converter.

What is claimed is:

1. A method of alloying steel by introducing a substance selected from the group consisting of metallic additives and mixtures of metallic additives and reducing agents in powder form into a liquid melt, said method comprising the steps of introducing alloying additives and mixtures of the alloying additives and reducing agents in powder form from a supply container through a delivery line to at least one lance or below-bath nozzle directly into the melt alone or in a mixture with a fluidizing agent whose proportion in relation to the substance is ≦20%, and controlling the pressure used for conveying the powder to at least 20 bar.

2. A method of alloying steel by introducing a substance selected from the group consisting of metallic additives and mixtures of metallic additives and reducing agents in powder form into a liquid melt, said method comprising the steps of introducing alloying additives and mixtures of the alloying additives and reducing agents in powder form from a supply container through a delivery line to at least one lance or below-bath nozzle directly into the melt alone or in a mixture with a fluidizing agent whose proportion in relation to the substance is ≦20%, and controlling the pressure used for conveying the powder to at least 20 bar that, at end and discharging powder in said delivery line into said melt with a plunger extending over the cross section of the delivery line.

3. The method defined in claim 2 wherein the pressure used for conveying the powder is at least 40 bar.

4. The method defined in claim 2, further comprising the step of increasing flowability of said substance by adding thereto a small amount of a component selected from the group consisting of inert gas and liquid hydrocarbons.

5. The method defined in claim 4 wherein said inert gas is selected from the group consisting of argon and nitrogen.

6. The method defined in claim 4 wherein said liquid hydrocarbons are selected from the group consisting of heating oil, diesel oil, heavy oil, waste oil, rape seed oil and paraffin.

7. The method defined in claim 2 wherein said substance has a maximum grain size of at most 1 mm.

8. The method defined in claim 7 wherein said maximum grain size is 0.1 mm.

9. The method defined in claim 2 wherein said substance is introduced into said melt with cores surrounded by a shell containing lubricants.

10. The method defined in claim 2 wherein said substance is injected into said melt by a swingable lance.

11. The method defined in claim 2 wherein said substance is injected into said melt from a ring nozzle.

12. The method defined in claim 2 wherein said substance is injected into said melt through a lance from which an inert gas is injected into said melt to cool said lance and produce a melt-stirring motion.

13. The method defined in claim 12 wherein said inert gas is introduced tangentially from said lance into said melt.

14. The method defined in claim 2 wherein said pressure is between 50 bar and 100 bar.

15. A device for introducing a substance selected from the group consisting of metallic additives and mixtures of metallic additives and reducing agents in powder form into a liquid melt of steel comprising a supply container for supplying said substance;

a pump connected to said supply container for displacing said substance in powder form at a pressure of at least 20 bar and with a fluidizing agent present in an amount by volume to and through a delivery line; and at least one lance or below-bath nozzle connected to said delivery line and opening below a level of the liquid melt into the liquid melt.

16. The device defined in claim 15, further comprising a metering device along said delivery line for incorporating into said powder said fluidizing agent in an amount of at most 20% by volume.

17. The device defined in claim 15 wherein said delivery line communicates with a lance having a double wall shell through which said substance is introduced into said melt, said lance having an opening for discharging a mixing gas into said melt.

18. The device defined in claim 15 wherein said delivery line opens into a lance which is swingable in said melt.

19. The device defined in claim 15, further comprising a container for said melt constituted with a ladle, a torpedo carriage or a converter.

* * * * *